US005803360A

United States Patent [19]

Spitznagel

[11] Patent Number: 5,803,360

[45] Date of Patent: Sep. 8, 1998

[54] APPARATUS FOR PROVIDING ENHANCED SPRAY CAPABILITIES FOR A GRAVITY-FED SPRAY GUN

[76] Inventor: Max W. A. Spitznagel, 13207 Warren Ave., Los Angeles, Calif. 90066

[21] Appl. No.: 563,207

[22] Filed: Nov. 27, 1995

[51] Int. Cl.[6] ..... B05B 7/30

[52] U.S. Cl. ..... 239/345; 239/377; 239/379; 285/190

[58] Field of Search ..... 239/345, 377, 239/379, 318; 285/190

[56] References Cited

U.S. PATENT DOCUMENTS

| | | | |
|---|---|---|---|
| 0,930,087 | 8/1909 | Reich | 239/345 |
| 1,748,440 | 2/1930 | Burdick | 239/345 |
| 2,887,274 | 5/1959 | Swenson | 239/379 |
| 2,961,335 | 11/1960 | Shepard | 239/345 |
| 3,236,459 | 2/1966 | McRitchie | 239/345 |
| 4,775,174 | 10/1988 | Dalla Bona et al. | 285/190 |
| 4,955,643 | 9/1990 | Bona et al. | 288/190 |
| 5,372,389 | 12/1994 | Tam et al. | 285/190 |
| 5,415,351 | 5/1995 | Otto et al. | 239/379 |
| 5,582,350 | 12/1996 | Kosmyna et al. | 239/345 |

FOREIGN PATENT DOCUMENTS

| | | | |
|---|---|---|---|
| 1512675 | 10/1989 | U.S.S.R. | 239/345 |
| 139833 | 3/1920 | United Kingdom | 239/345 |

*Primary Examiner*—Andres Kashnikow
*Assistant Examiner*—Lisa Ann Douglas

[57] ABSTRACT

An apparatus for providing enhanced spray capabilities for a gravity-fed spray gun which extends along a spray gun plane, a spray gun nozzle axis extending along that spray gun plane. The apparatus includes a swivel joint assembly for connecting the spray gun to a fluid cup having a fluid cup central axis. The swivel joint assembly provides rotation of the fluid cup along a fluid cup offset axis. The fluid cup offset axis is perpendicular to the fluid cup axis. The position of the offset axis is defined by the intersection of the fluid cup axis and the spray gun plane.

8 Claims, 4 Drawing Sheets

APPARATUS FOR PROVIDING ENHANCED SPRAY CAPABILITIES FOR A GRAVITY-FED SPRAY GUN

BACKGROUND OF THE INVENTION

1. Field of the Invention

The present invention relates to gravity-fed spray guns and more particularly to an apparatus for providing enhanced spray capabilities for such gravity-fed spray guns.

2. Description of the Related Art

Spray guns are commonly used to apply paint, primer or any other liquid substance to a surface. The most common handicap a painter encounters, regardless of whether he is using a gravity or suction spray gun is the inability to go low enough to paint upward. For example, in the auto body industry, the rocker-panel (below the door line) is seldom painted on the lower surfaces. The reason for this deficiency is that the car is too low to the ground and the spray gun assembly is too long to provide for proper access. A gravity-fed spray gun, excluding regulator and hose connection is generally 11 to 13 inches long. A suction spray gun is generally 13 inches long excluding regulator and hose connection. The spray gun cannot be tilted sideways without the possibility of paint spilling from the cup or having the smooth flow of paint to the gun being interrupted.

Similar problems exist in the paint industry, generally. For example, in spraying overhead the painter cannot always conveniently tilt the spray at the proper angle for proper application of the paint, or other surface treatments.

OBJECTS AND SUMMARY OF THE INVENTION

It is therefore a principal object of the present invention to provide efficient use of a gravity-fed spray gun for surfaces not easily accessible, such as low surfaces and overhead surfaces.

This and other objects are achieved by the present invention which is, an apparatus for providing enhanced spray capabilities for a gravity-fed spray gun which extends along a spray gun plane, a spray gun nozzle axis extending along that spray gun plane. In its broad aspect, the present invention comprises a swivel joint assembly for connecting the spray gun to a fluid cup having a fluid cup central axis. The swivel joint assembly provides rotation of the fluid cup along a fluid cup offset axis. The fluid cup offset axis is perpendicular to the fluid cup axis. The position of the offset axis is defined by the intersection of the fluid cup axis and the spray gun plane.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figure 1:
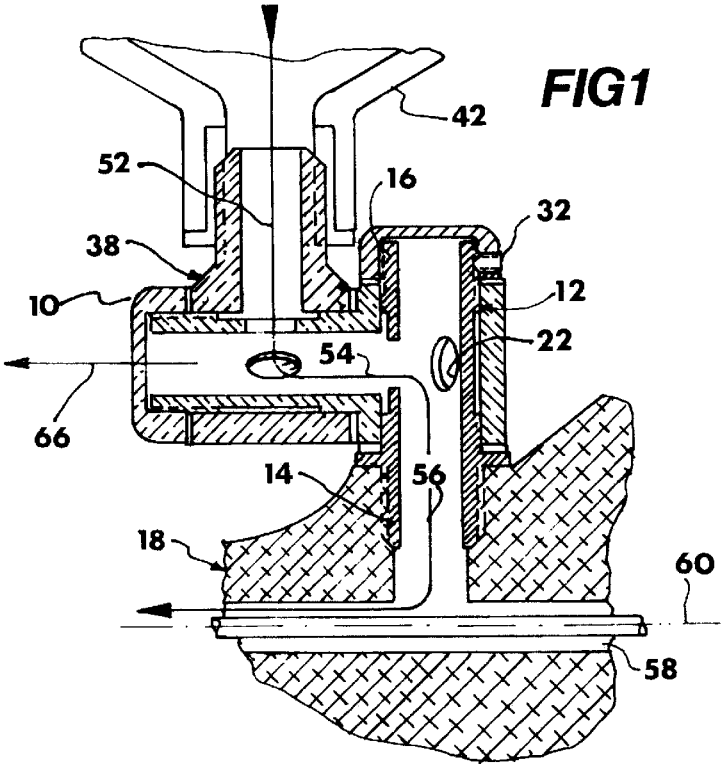
FIG. 1 is a cross-sectional view of a first embodiment of the present invention which can be rotated about two different axes.
Figure 2:
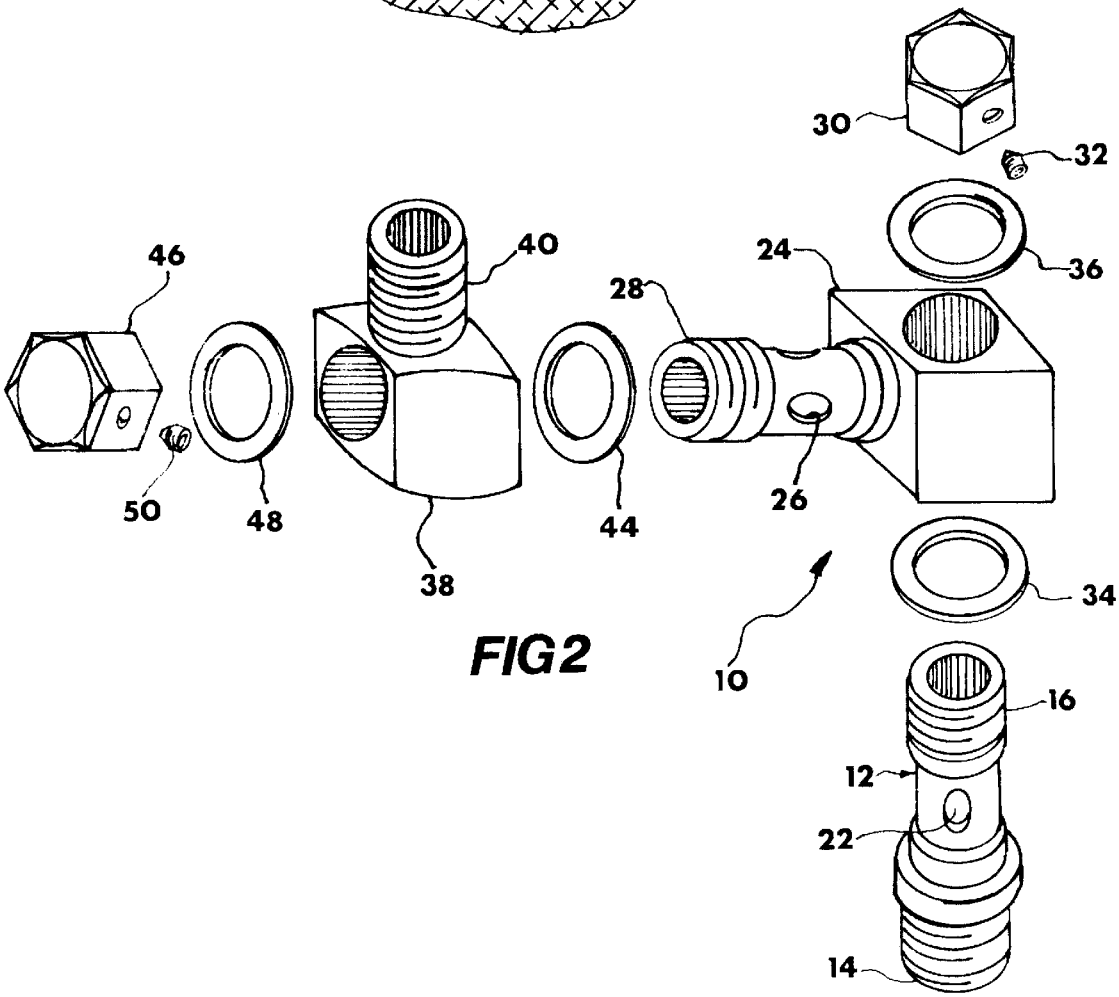
FIG. 2 is an exploded perspective view of the FIG. 1 embodiment.

Referring now to the drawings and the characters of reference marked thereon FIGS. 1 and 2 illustrate a first embodiment of the present invention, designated generally as 10. A nipple 12 has external threads 14, 16 on each end thereof. A first end of the nipple 12 fastens to internal threads in the spray gun body 18. Nipple 12 is hollow for providing transfer of fluid therein. It includes a plurality of spaced openings 22 for providing fluid transfer.

A first banjo fitting 24 is rotatably mounted about the periphery of the nipple 12. The first banjo fitting 24 has an orthogonal extension 26 with external threads 28 on the end thereof. Banjo fittings are well known in various industries.

A first cup nut 30 is fastened to the second end of the nipple 12 for rotatably mounting the first banjo fitting to the nipple 12. A set screw or bolt 32 is preferably provided for adjustably securing the first cup nut 30 in a desired position to obtain the desired friction of the first banjo fitting 24 relative to the nipple 12.

A first seal or gasket 34 seals the first banjo fitting 24 relative to the nipple 12. A second gasket or seal 36 seals the first banjo fitting 24 relative to the first cup nut 30.

A second banjo fitting 38 is rotatably mounted on the orthogonal extension 26. The second banjo fitting 38 has an orthogonal extension 40 with external threads for mounting a fluid cup 42 thereon. A third seal or gasket 44 seals the second banjo fitting 38 relative to the first banjo fitting 24. A second cup nut 46 fits onto the external threads 28 at the end of the first banjo fitting 24 for securing the first banjo fitting 24 to the second banjo fitting 38. A fourth seal or gasket 48 seals the second cup nut 46 relative to the second banjo fitting 38. A bolt or second locking means 50 adjustably secures the second cup nut 46 in a desired position to obtain the desired friction of the second banjo fitting 38 relative to the first banjo fitting 24.

The banjo fittings, nipple and cup nuts may be formed of any suitable material such as brass or stainless steel.

Thus, fluid is transferred from within the fluid cup 42 through the second banjo fitting 38, as shown at position 52. The fluid transfers through the second banjo fitting 38 to the first banjo fitting 24, as shown at position 54. It is then transferred through the nipple, as shown at position 56. From nipple 56 the fluid is directed through the gun body and through the nozzle 58, as designated by numeral designation 60.

Figure 3:
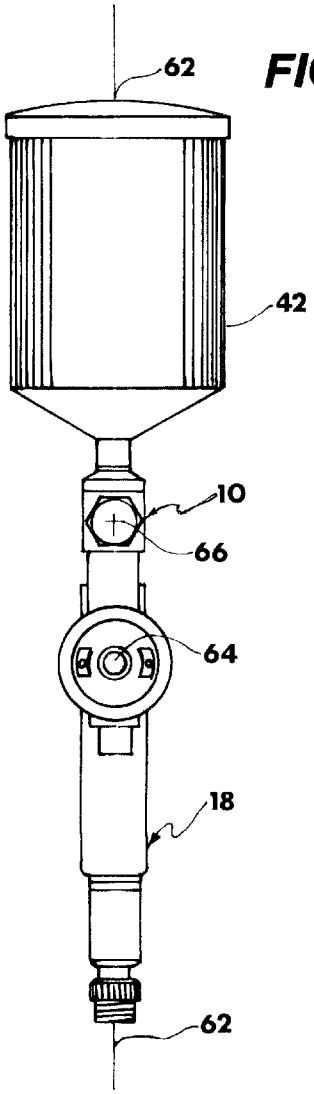
FIG. 3 is a front view of a spray gun having the swivel joint of the present invention attached thereto.
Figure 11:
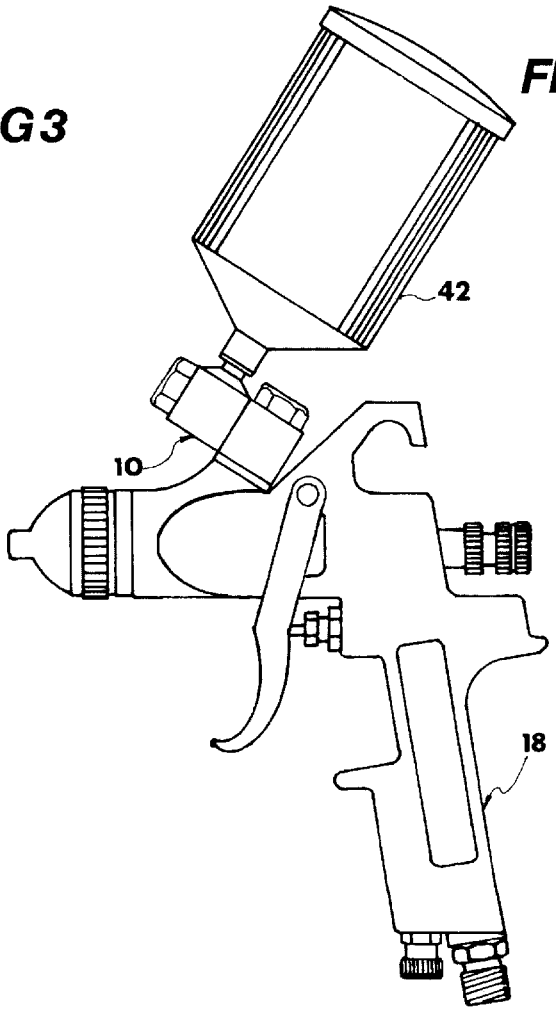
FIG. 11 is a side view of the first embodiment of the present invention secured to a spray gun.

Referring now to FIGS. 3–5 and 11, the versatility of the present invention is illustrated. In FIG. 3, the fluid cup 42 and the spray gun 18 are both in a vertical position. It is noted that the spray gun lies along a spray gun plane 62. The nozzle axis 64 extends along the spray gun plane 62. It is further noted that the fluid cup 42 has a central axis thereon. In this position the central axis of the fluid cup lies along the spray gun plane 62. The swivel joint assembly 10 of the present invention provides rotation of the fluid cup 42 about a fluid cup offset axis 66. The fluid cup offset axis 66 is perpendicular to the fluid cup axis. The position of the offset axis 66 is defined by the intersection of the fluid cup central axis and the spray gun plane 62.

Figure 4:
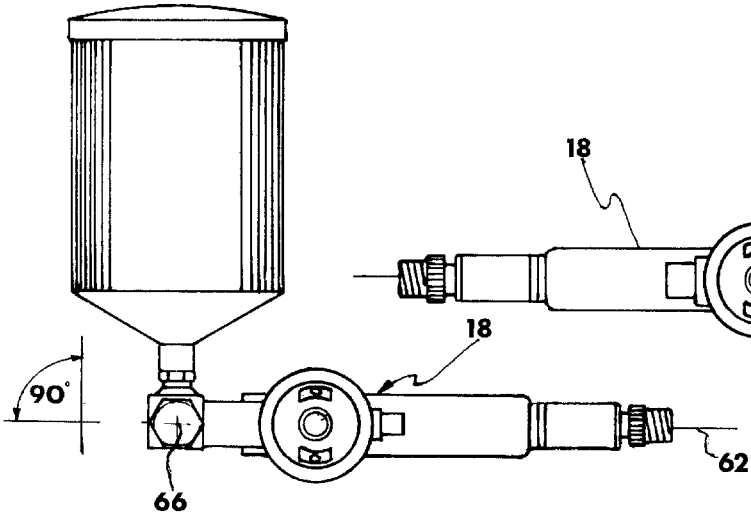
FIG. 4 is another front view showing the gun body rotated counter-clockwise 90° with the cup remaining in the vertical position.

Referring now to FIG. 4, the gun body 18 is shown rotated counter-clockwise 90° with the cup 42 remaining in the vertical position. Relative rotation between the cup 42 and the spray gun plane 62 is provided along the offset axis 66.

Figure 5:
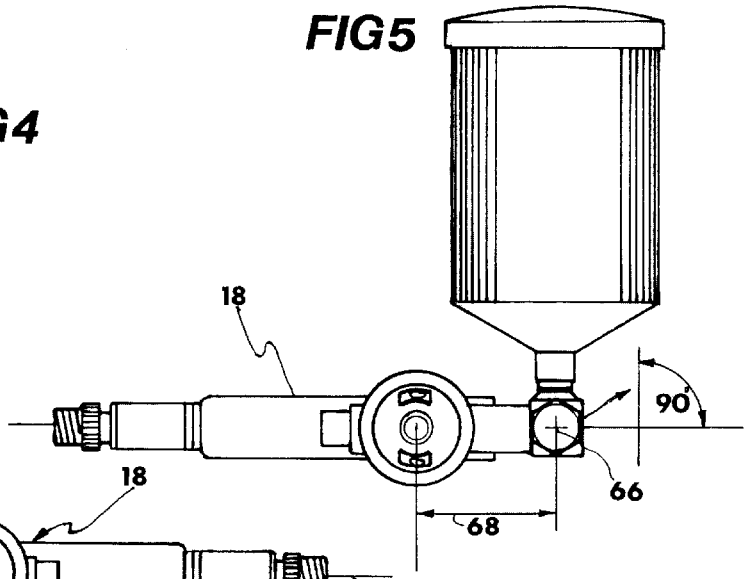
FIG. 5 is another front view showing the gun body rotated clockwise 90° with the cup remaining in the vertical position.

Similarly, in FIG. 5, the spray gun body 18 is shown rotated clockwise 90° from the FIG. 3 position, again allowed to be rotated along the offset axis 66. It is noted that the term "offset axis" has been used because, in effect, the offset axis is an axis "offset" from the spray gun nozzle 64 by a specified distance, as noted by Line 68.

The advantages of this invention are bountiful. By being able to maintain the fluid cup 42 in a vertical position while being able to rotate the spray gun to a comfortable desired angle, many painting and other spraying applications are realizable which otherwise could not be provided. For example, currently, painting of the rocker panels underneath the doors of the automobile, the wheel housings, or wheel openings, and painting on the roof of the automobile are all problematic because paint often drips out of the cup or off the cup or the fluid cannot get to the nozzle because of the undesired orientation of the fluid cup. The present invention alleviates these problems allowing the fluid cup 42 to remain in a vertical position regardless of the angle of the spray gun.

Figure 6:
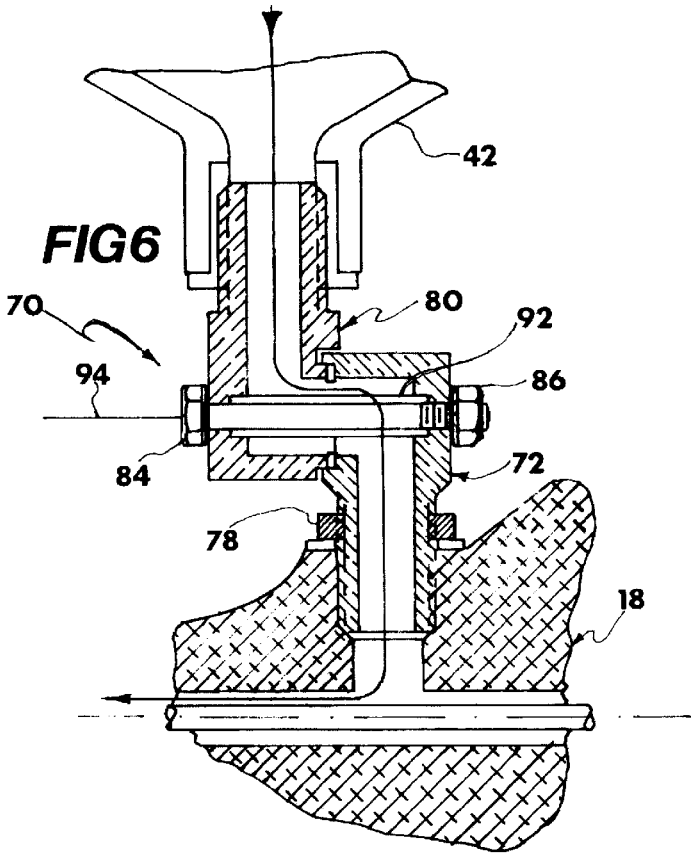
FIG. 6 is a cross-sectional view of a second embodiment of the present invention in which less machined parts are required.
Figure 7:
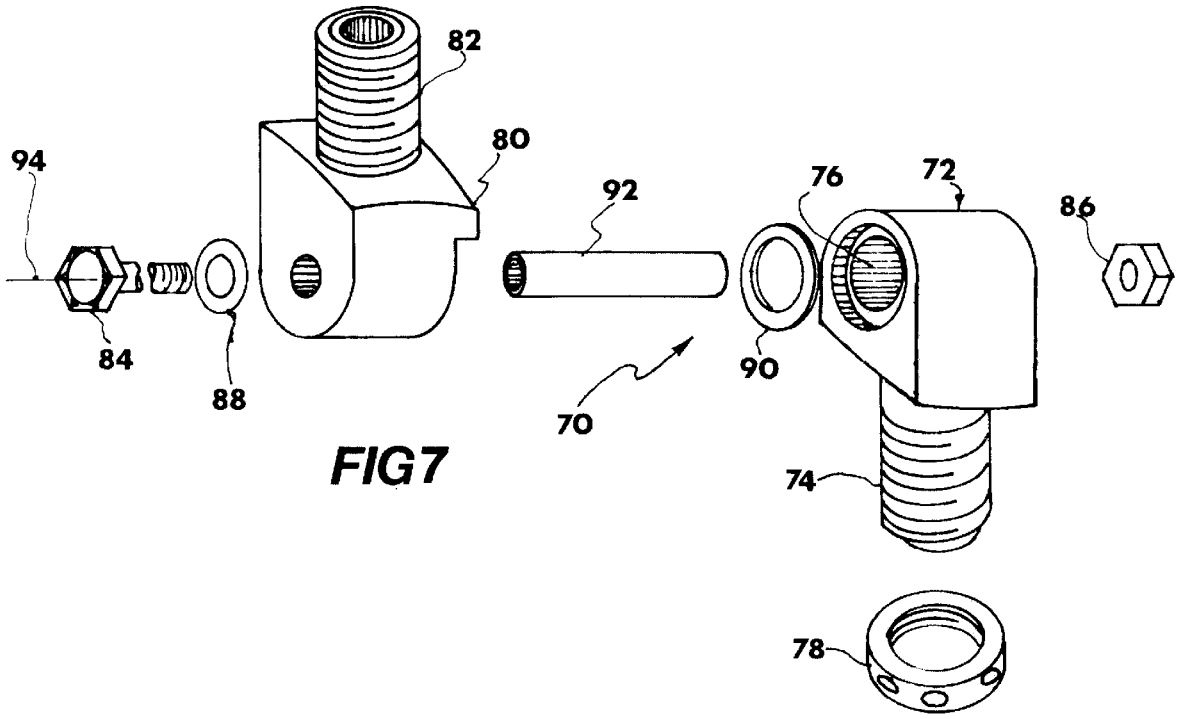
FIG. 7 is an exploded perspective view of the FIG. 6 embodiment.

Referring now to FIG. 6, a second embodiment of the present invention is illustrated, designated generally as 70. A first banjo fitting 72 having threads 74 on the first end thereof is fastened to threads on the spray gun body 18. The first banjo fitting 72 has a second end with an opening 76 orthogonal to the first end. A locking nut 78 locks and secures the position of the first banjo fitting 72 relative to the spray gun body 18. A second banjo fitting 80 has a first end with an opening therethrough and an orthogonal extension 82 on the second end thereof. A screw 84, locking nut 86 and sealing means 88, 90 secure the first banjo fitting 72 to the second banjo fitting 80. They provide relative rotation therebetween and provide fluid communication between the orthogonal opening on the second end 76 of the first banjo fitting 72 and the opening on the first end of the second banjo fitting 80. A tube 92 is preferably provided for assuring a proper seal. The orthogonal end 82 is preferably threaded for securely connecting the fluid cup 42 to this orthogonal extension 82.

The screw 84 and nut 86 can be tightened to adjust the friction between the banjo fittings. The offset axis is designated 94 in this figure.

The second embodiment 70 has fewer machined parts than the first embodiment 10, however, it is rotatable only about the one offset axis 94.

Figure 8:
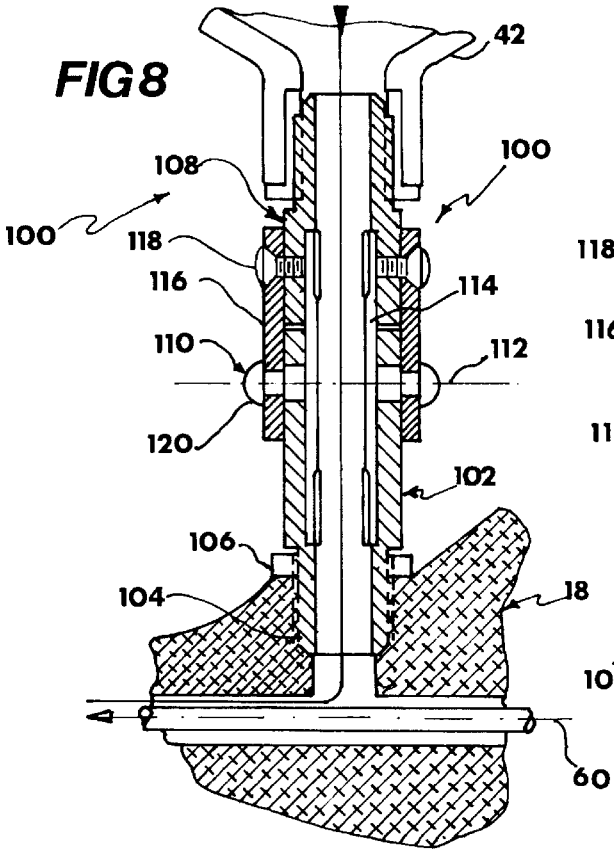
FIG. 8 is a cross-sectional view of a third embodiment of the present invention which utilizes tubing within the swivel joint for convenient cleaning, particularly useful for applications involving high viscosity working fluids.
Figure 9:
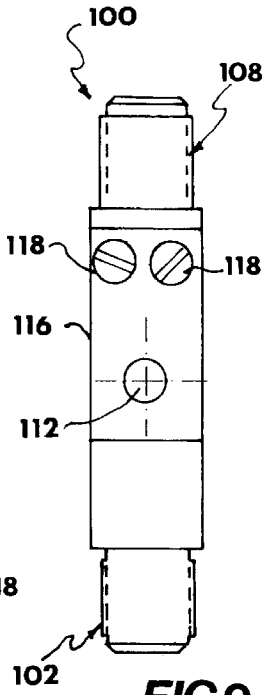
FIG. 9 is a front view of the FIG. 8 embodiment.
Figure 10:
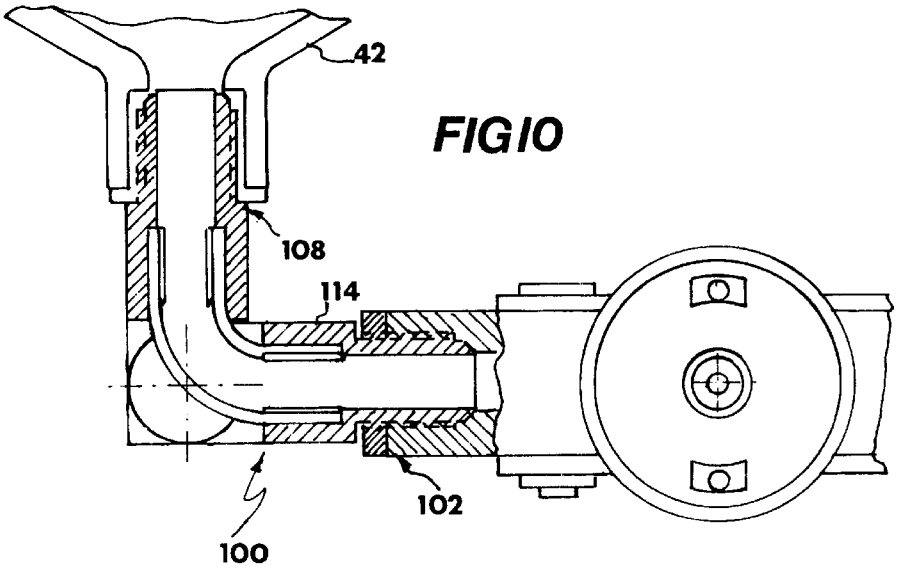
FIG. 10 is a front view, partially in cross-section of the FIG. 8 embodiment.

Referring now to FIGS. 8–10, a third embodiment of the present invention is illustrated, designated generally as 100. A first fitting 102 has an opening extending therethrough and threads 104 on a first end thereof for fastening the first fitting 102 to threads on the spray gun body 18. A locking nut 106 is provided for locking and securing the position of the first fitting 102 relative to the gun body 18. A second fitting 108 has an opening extending therethrough. A pair of pin means 110 secure a second end of the first fitting 102 to a first end of the second fitting 108. Such pin means may include, for example, pins, screws or posts. These pin means 110 provide relative rotation between the first fitting 102 and the second fitting 108. This axis of rotation 112 is, in this embodiment, the offset axis. A tube 114 extends between the first and second fittings 102, 108 for providing fluid communication between the fittings. The second end of the second fitting 108 is threaded to secure this fitting 108 to the fluid cup 42.

A pair of plates 116 and screws 118 are provided which cooperate with pins 120 to secure the fittings together and provide the appropriate relative rotation therebetween.

Similar problems exist in the paint industry, generally. For example, in spraying overhead the painter cannot always conveniently tilt the spray at the proper angle for proper application of the paint, or other surface treatments.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An apparatus for providing enhanced spray capabilities for a gravity-fed spray gun, said spray gun extending along a spray gun plane, a spray gun nozzle axis extending along said spray gun plane, comprising:

a swivel joint assembly for connecting said spray gun to a fluid cup having a fluid cup central axis, said swivel joint assembly providing rotation of said fluid cup about a fluid cup offset axis, said fluid cup offset axis perpendicular to said fluid cup central axis, said fluid cup offset axis being along said spray gun plane, the position of said offset axis being defined by the intersection of said fluid cup central axis and said spray gun plane, wherein said swivel joint assembly, comprises:

a) nipple having external threads on each end thereof, a first end for fastening to internal threads in said spray gun body;

b) a first banjo fitting rotatably mounted about the periphery of said nipple, said first banjo fitting having an orthogonal extension with external threads on the end thereof;

c) a first cup nut fastened to a second end of said nipple for rotatably mounting said first banjo fitting to said nipple:

d) a first seal for sealing said first banjo fitting relative to said nipple;

e) a second seal for sealing said first banjo fitting relative to said first cup nut;

f) a second banjo fitting rotatably mounted on said orthogonal extension, said second banjo fitting having an orthogonal extension with external threads for mounting said fluid cup thereon;

g) a third seal for sealing said second banjo fitting relative to said first banjo fitting;

h) a second cup nut fitting onto said external threads at said end of said first banjo fitting, for securing said first banjo fitting to said second banjo fitting; and i) a fourth seal for sealing said second cup nut relative to said second banjo fitting, wherein said fluid cup which is attached to said orthogonal extension of said second banjo fitting may be rotated at a desired angle to accommodate various spray angles and positions.

2. The apparatus of claim 1, further comprising:

first locking means for adjustably securing said first cup nut in a desired position to obtain the desired friction of said first banjo fitting relative to said nipple.

3. The apparatus of claim 2, further comprising:

second locking means for adjustably securing said second cup nut in a desired position to obtain the desired friction of said second banjo fitting relative to said first banjo fitting.

4. An apparatus for providing enhanced spray capabilities for a gravity-fed spray gun, said spray gun extending along a spray gun plane, a spray gun nozzle axis extending along said spray gun plane, comprising:

a swivel joint assembly for connecting said spray gun to a fluid cup having a fluid cup central axis, said swivel joint assembly providing rotation of said fluid cup about a fluid cup offset axis, said fluid cup offset axis perpendicular to said fluid cup central axis, said fluid cup offset axis being along said spray gun plane, the position of said offset axis being defined by the intersection of said fluid cup central axis and said spray gun plane, wherein said swivel joint assembly, comprises:

a) a first banjo fitting having fastening means on a first end thereof for fastening said first banjo fitting to threads on said spray gun body, said first banjo fitting having a second end with an opening orthogonal to said first end;

b) a locking means for locking and securing the position of said first banjo fitting relative to said spray gun body;

c) a second banjo fitting having a first end with an opening therethrough, and an orthogonal extension on the second end thereof:

d) securing and sealing means for securing said first banjo fitting to said second banjo fitting and for providing relative rotation therebetween and providing fluid communication between said orthogonal opening on said second end of said first banjo fitting and said opening on said first and of said second banjo fitting; and e) means for securely connecting said fluid cup to said orthogonal extension of said second banjo fitting, wherein said fluid cup which is attached to said orthogonal extension of said second banjo fitting may be rotated at a desire dangle to accommodate various spray angles and positions.

5. The apparatus of claim 4, wherein said fastening means on said banjo fitting comprises threads.

6. The apparatus of claim 4, wherein said locking means comprises a nut.

7. The apparatus of claim 4, wherein said securing and sealing means comprises screw, locking nut and sealing means.

8. An apparatus for providing enhanced spray capabilities for a gravity-fed spray gun, said spray gun extending along a spray gun plane, a spray gun nozzle axis extending along said spray gun plane, comprising:

a swivel joint assembly for connecting said spray gun to a fluid cup having a fluid cup central axis, said swivel joint assembly providing rotation of said fluid cup about a fluid cup offset axis, said fluid cup offset axis perpendicular to said fluid cup central axis, said fluid cup offset axis being along said spray gun plane, the position of said offset axis being defined by the intersection of said fluid cup central axis and said spray gun plane, wherein said swivel joint assembly, comprises:

a) a first fitting having an opening extending therethrough and threads on a first end thereof for fastening said first fitting to threads on said spray gun body;

l) a locking nut for locking and securing the position of said first fitting relative to said gun body;

k) a second fitting having an opening extending therethrough, said second fitting having a first end and a second end;

l) a pair of pin means for securing a second end of said first fitting to said first end of said second fitting, and for providing relative rotation therebetween;

m) a tube extending between said first and second fittings for providing fluid communication between said fitting; and n) means for securing said fluid cup to said second end of said second fitting, wherein said fluid cup may be rotated at a desired angle to accommodate various spray angles and positions.

* * * * *